US005735637A

United States Patent [19]

Gunter

[11] Patent Number: 5,735,637

[45] Date of Patent: Apr. 7, 1998

[54] METHOD AND APPARATUS FOR SUPPORTING AND ANCHORING DRAINAGE CHANNEL SECTIONS

[75] Inventor: Charles E. Gunter, Mooresville, N.C.

[73] Assignee: ABT, Inc., Troutman, N.C.

[21] Appl. No.: 657,370

[22] Filed: Jun. 3, 1996

[51] Int. Cl.[6] ..... F02B 5/00

[52] U.S. Cl. ..... 405/118; 404/3; 405/36

[58] Field of Search ..... 405/36, 118, 119, 405/121, 122; 404/2, 3, 5; 24/336

[56] References Cited

U.S. PATENT DOCUMENTS

| | | |
|---|---|---|
| 139,324 | 5/1873 | McClunie . |
| 1,022,008 | 4/1912 | Swick . |
| 1,087,791 | 2/1914 | Leavitt . |
| 2,386,020 | 10/1945 | Wendelken . |
| 2,978,840 | 4/1961 | Tatsch . |
| 3,347,275 | 10/1967 | Murphy . |
| 3,433,137 | 3/1969 | Henderson . |
| 3,552,579 | 1/1971 | Simon et al. . |
| 3,568,455 | 3/1971 | McLaughlin et al. . |
| 3,841,101 | 10/1974 | Henfrey . |
| 4,099,354 | 7/1978 | DePirro . |
| 4,268,189 | 5/1981 | Good . |
| 4,338,045 | 7/1982 | Cour . |
| 4,498,807 | 2/1985 | Kirkpatrick et al. . |
| 4,749,307 | 6/1988 | Huffaker et al. . |
| 4,787,773 | 11/1988 | Kehler . |
| 4,844,655 | 7/1989 | Aleshire . |
| 4,878,782 | 11/1989 | Beattie et al. . |
| 4,940,359 | 7/1990 | Van Duyn et al. . |
| 4,993,878 | 2/1991 | Beamer . |
| 5,000,621 | 3/1991 | Beamer . |
| 5,066,165 | 11/1991 | Wofford et al. . |
| 5,213,438 | 5/1993 | Bärenwald . |
| 5,226,748 | 7/1993 | Bärenwald et al. . |
| 5,256,000 | 10/1993 | Beamer . |
| 5,281,051 | 1/1994 | Stegall . |
| 5,281,052 | 1/1994 | Beamer . |
| 5,326,189 | 7/1994 | Beamer . |
| 5,326,190 | 7/1994 | Beamer . |
| 5,372,457 | 12/1994 | Ravte ..... 404/3 X |

(List continued on next page.)

FOREIGN PATENT DOCUMENTS

| | | |
|---|---|---|
| 964440 | 3/1975 | Canada . |
| 25 06 705 | 8/1976 | Germany . |
| 8715791 U | 3/1988 | Germany . |
| 9211253 U | 12/1992 | Germany . |
| 57-178019A | 11/1982 | Japan . |
| 62-260911A | 11/1987 | Japan . |
| 4-73337A | 3/1992 | Japan . |
| 588 597 | 6/1977 | Switzerland . |
| WO7900848 | 11/1979 | WIPO . |

OTHER PUBLICATIONS

ABT, Inc., *Polydrain® Installation Notes*, 1989.

ACO Polymer Products, Inc., *ACO Drain Technical Installation.*

ABT, Inc., *Polydrain® Special Products By ABT, Inc.*

*Primary Examiner*—Tamara L. Graysay

*Assistant Examiner*—Frederick L. Lagman

*Attorney, Agent, or Firm*—Bell Seltzer Intellectual Property Law Group of Alston & Bird, LLP

[57] ABSTRACT

A support frame assembly is provided for supporting drainage channel sections adjoined in an end-to-end relationship and for anchoring the drainage channel sections to a support surface. The support frame assembly includes a pair of substantially vertical legs and a channel support piece mounted to the upper end portion of each of the legs for supporting the drainage channel sections. The support frame assembly also includes a cross member extending between the lower end portions of the legs at a position below the channel support pieces. In one embodiment, a pair of aligned openings are provided in the cross member and one of the legs so that an anchor member can be driven through the openings and enter the support surface at an acute angle relative thereto. In another embodiment, hinge members are provided between the cross member and the legs so that the cross member can be oriented to sit flat on a sloped surface. Associated methods also form a part of the invention.

51 Claims, 3 Drawing Sheets

U.S. PATENT DOCUMENTS 5,399,047 3/1995 Stegall .
5,478,169 12/1995 Stegall ..... 404/4 X
5,522,675 6/1996 Gunter .
5,529,436 6/1996 Meyers ..... 404/4 X
5,538,361 7/1996 Beamer ..... 404/4 X
5,573,350 11/1996 Stegall ..... 404/4 X

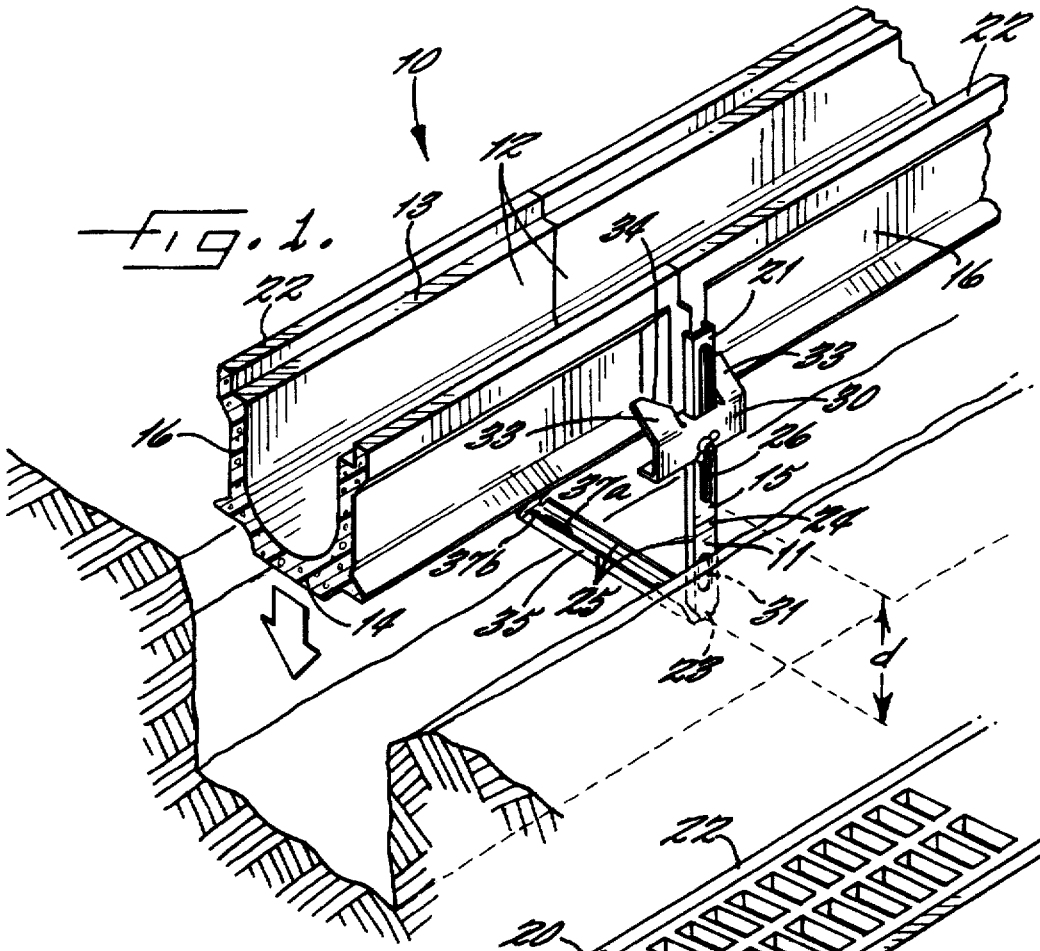
Fig. 1.
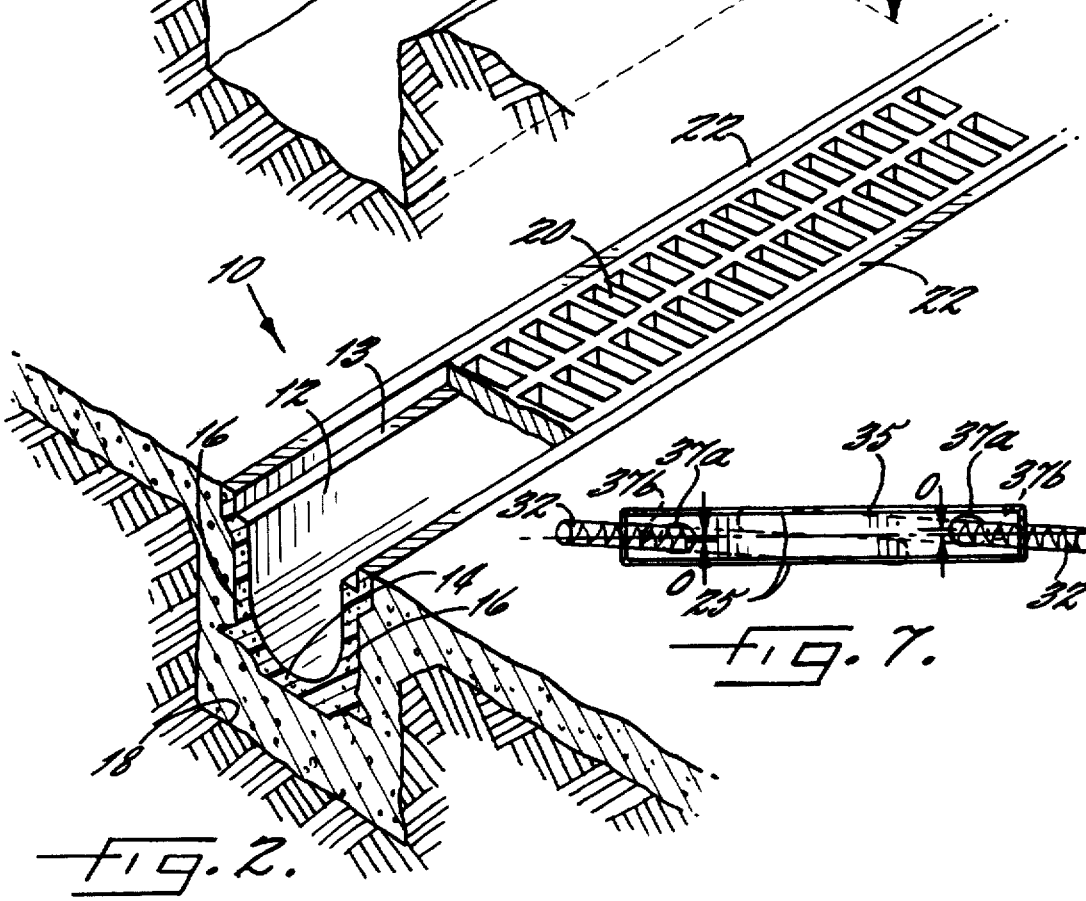
Fig. 2.
Fig. 7.

METHOD AND APPARATUS FOR SUPPORTING AND ANCHORING DRAINAGE CHANNEL SECTIONS

FIELD OF THE INVENTION

The invention relates to methods and apparatus for forming trenches. More particularly, the invention relates to methods and apparatus for forming trenches with precast drainage channel sections.

BACKGROUND OF THE INVENTION

Drainage and other trenches of various sizes and shapes are desirable for numerous applications. For example, manufacturing facilities typically require drainage systems which include trenches formed in the building floors to collect, remove and/or recycle excess water or other liquids. These trenches may also be used as utility chases to provide temporary or permanent routing of electrical lines, pipes, conduits or the like below the level of the building floor. In addition, numerous outdoor industrial and commercial sites, such as large parking lots and airports, require drainage systems, including trenches, to collect and direct rainwater and other liquids to underground storm sewers to prevent flooding and to decrease runoff.

In the past, these trenches have generally been formed by first placing and securing a number of precast drainage channel sections in a ditch which has previously been formed in the ground. A hardenable composition, such as cement, concrete or the like, is then poured around the drainage channel sections and is allowed to set. In particular, the drainage channel sections are supported on a plurality of downwardly extending legs which are positioned on the earthen surface at the bottom of the ditch. A first pour of concrete is made to a level below the drainage channel sections and allowed to harden thus forming a subslab. A second pour of concrete is then applied over the subslab up to the upper edges of the drainage channel sections to fully embed the trench. The subslab is necessary to prevent the buoyancy of the drainage channel sections in the wet concrete from causing the sections to float out of position and become misaligned.

Once the concrete has set, it is normally desirable to finish the trench with a trench cover, such as an elongate grate covering its open top, in order to prevent people from unwittingly stepping in the open trench, to provide a smooth surface for vehicle travel, and/or to prevent relatively large objects from entering the trench and potentially blocking the flow of liquid therethrough. The trench cover is generally supported by a support surface defined longitudinally along an inner portion of each opposed sidewall of the drainage channel sections.

In order to stabilize the trench cover to prevent the trench cover from rocking when weight, such as from a passing vehicle, is applied thereto, the support surfaces defined by the opposed sidewalls of the drainage channel sections must be aligned in a common plane during the pouring and setting of the concrete about the drainage channel sections. In addition, if the trench cover is not properly aligned, the trench cover and/or the drainage channel itself can be damaged by the resulting movement of the trench cover. Furthermore, if the trench cover rocks excessively, the trench cover may even be dislodged from the drainage channel to expose the trench defined thereby. Accordingly, the alignment of the drainage channel sections in the hardenable composition is important to the construction of a satisfactory trench.

Many drainage and other trenches are formed of a number of drainage channel sections. It is also important to align the adjacent drainage channel sections such that the sidewalls and bottom wall of the trench defined by the adjacent drainage channel sections form continuous surfaces such that fluid flows smoothly therethrough and does not pool within the trench.

One common method of securing precast channel sections in an aligned relationship within a preformed ditch includes an anchor, such as that described in U.S. Pat. No. 4,498,807 which issued on Feb. 12, 1985 to Larry E. Kirkpatrick, et al. and assigned to Polydrain, Inc. (hereinafter the "'807 patent"). As illustrated in the '807 patent, the anchor generally includes a pair of downwardly extending, elongated spikes which are held in a parallel, spaced-apart relationship by a generally rectangular crosspiece. The anchor also includes a pair of upwardly extending arms that have a predefined shape which corresponds to and engages the predetermined exterior shape of lower portions of the precast channel sections. For example, each opposed sidewall of the precast channel sections can include an outwardly projecting rib extending longitudinally along lower portions of the channel sections. Correspondingly, upper portions of the arms of the anchor can include inwardly extending tabs which engage the longitudinally extending ribs and secure the anchor to lower portions of the channel sections. Accordingly, the anchor can be attached to a precast channel section and the elongated spikes can be inserted into the ground such that the drainage channel section is held at a fixed position within the preformed ditch. Concrete can thereafter be poured about the channel sections to form the completed trench.

The anchors of the drainage channel system of the '807 patent therefore provide a means to accurately position or place each drainage channel section within the ditch. Accordingly, adjacent drainage channel sections can be aligned such that the side walls and bottom surfaces of the channel sections are contiguous. In one embodiment, the bottom surfaces of the drainage channel sections include a bottom surface which has a predetermined slope to facilitate drainage or fluid flow. According to this embodiment, the anchors of the drainage channel system of the '807 patent can position the individual drainage channel sections in an aligned relationship such that the presloped bottom surfaces are contiguous.

One advantage of the anchor of the '807 patent is that it allows for the concrete to be applied in one pour. In contrast to the conventional systems discussed above which require two pours (one of which creates the anchoring subslab), the anchor of the '807 patent restrains the buoyant forces of the wet concrete and ensures that the drainage channel sections do not shift.

Difficulties may arise, however, when the ditch is to be formed in loose or nonconsolidated earth, such as may be encountered in rocky or sandy areas. In particular, the underlying soil may be so loose that the anchor does not sufficiently restrain the drainage channel sections. The frictional forces applied to the sides of the elongated spikes may not be as large as the upward buoyant forces placed on the drainage channel sections and, accordingly, the spikes will be pulled upwardly from the soil. Accordingly, there is a need for a drainage channel section support frame which has improved anchoring abilities for allowing a single concrete pour in loose, sandy or rocky soil.

Some areas may even have soil conditions which are so loose or rocky as to prevent any anchor type system from functioning properly. In particular, extremely rocky conditions may prevent the spikes from being driven into the soil or can deflect the spikes as they are driven into the soil. Thus, in those areas, it is necessary to use the conventional two-pour method by first weighing down the drainage channel sections with a subslab. With the system of the '807 patent, however, it is always necessary to first drive the spikes into the soil, even if the soil is so loose or rocky as to require a subslab. Thus, it would be desirable to provide a support frame which does not require driving spikes into the soil when such an action will be redundant and unnecessary.

The support surface on which the support frame is placed (and to which it may be anchored) is not always level. For example, the bottom surface of the ditch may be transversely sloped from side to side as a result of the excavation. Conventional systems, however, are not well adapted to be placed on sloping surfaces. As such, there is a need for a drainage channel support frame which can be placed on a sloped support surface.

Drainage channel systems may also be installed on supporting surfaces other than the bottom surface of an earthen ditch. One example is in applications where the support frame is supported on an underlying concrete form, such as is common in parking deck structures. It is thus desirable to provide a drainage channel support frame which can be anchored to a metal or wooden concrete form. It would be especially desirable if such a support frame would also be capable of being supported on a sloped underlying concrete form.

Drainage channel systems can also be used for containment of spills of hazardous or other liquids. A drainage channel system may encircle one or more large liquid vessels to capture the entire volume of liquid in those vessels in the event of a major leak or rupture. To ensure complete containment, however, a curb is often provided on the opposite side of the drainage channel to form a fixed and insurmountable barrier. In the event of a spill, all of the spilled liquid will be combined by the curb and ultimately drained into the drainage channel system. Formation of a separate drainage channel and curb is laborious and expensive, however, and thus there is a need for a system which provides the drainage and barrier functions of prior systems in one combined package, Accordingly, there is a need for a drainage channel support frame with improved anchoring capabilities in loose soil. However, the support frame should not require driving stakes into the soil when a subslab is unavoidable or is desired for other reasons. Moreover, there is a need for a support frame which can be used on a sloped support surface such as in an earthen ditch or on an underlying concrete form. There is also a need for a drainage channel system which can perform the barrier functions of a curb. Preferably, all of these needs would be met by a single support frame so that such a frame would be versatile and could be used in many varied applications.

SUMMARY OF THE INVENTION

All of these needs and others are met by the methods and apparatus for supporting and anchoring drainage channel sections according to the present invention. In particular, the present invention provides a support frame assembly including a pair of legs, a cross member extending therebetween and at least one anchor member for anchoring the cross member to a support surface.

The legs are generally parallel and extend in a substantially vertical direction. Each of the legs has an upper end portion and a lower end portion. In one advantageous embodiment, the legs are formed of a channel section having a central wall and a pair of opposed sidewalls.

A channel support piece is mounted on each of the parallel legs adjacent to the upper end portions thereof for supporting the adjoining drainage channel sections. In another advantageous embodiment, the central wall of each leg includes a slot having upper and lower ends and a fastener extending through the slot for fastening the channel support piece to the respective leg. Advantageously, the lower end of the slot terminates at a predetermined distance above the cross member to ensure that there is always an adequate thickness of hardenable composition below the drainage channel sections.

A cross member extends between the lower end portions of the parallel legs at a position below the channel support pieces. The cross member may also be formed of a channel section having a central wall and a pair of opposed sidewalls. Advantageously, the legs and cross member are made of a single continuous piece of channel section steel.

At least one opening is provided in the cross member adjacent to the support surface. The opening is advantageously adapted to allow an anchor member to extend therethrough and engage the support surface to thereby anchor the frame to the surface. The anchor member may be a substantially rigid rod which is driven through the opening and into the bottom surface of an earthen ditch. The anchor member may also be a nail which is hammered into a wooden form or a screw which is screwed into a metal form.

Each of the legs may also define an opening which is aligned with a respective opening in the cross member. Accordingly, the anchor member can extend through the opening in the leg and the respective aligned opening in the cross member at an acute angle relative to the cross member. In addition, however, the anchor member can extend into the support surface at an acute angle relative thereto which makes the anchor member and support frame considerably more resistant to the buoyant forces of the concrete than conventional anchoring systems. Moreover, if the use of an anchor member is not required (such as when the soil is too loose), the anchor members according to the present invention do not have to be driven into the support surface and the cross member will serve to join subslab to the drainage channel sections.

The anchor members may be rods having a circular cross section and, in such instances, the openings are preferably oval in shape. Two anchoring members may be used and driven into the support surface at opposed angles so that the anchor members are driven towards each other. One or more of the openings in the legs or cross member may be offset from a center axis of the cross member and legs extending transversely to the drainage channel sections. Preferably, both of the openings in the cross member are slightly offset from the center axis in opposite directions. Accordingly, the anchor members may be driven into the ground until they cross under the cross member. The offset openings ensure that the anchor members do not strike each other underground.

In another advantageous embodiment of the present invention, hinge members are provided for connecting the cross member with each of the lower end portions of the legs. The hinge members allow the legs to be moved about the respective hinge member relative to the cross member so that the legs can be oriented to define a predetermined angle with the cross member. In particular, the bending rigidity of the hinge members is less than the bending rigidity of the legs. When the legs and cross member are formed of a continuous channel section, notches may be provided in the sidewalls at the corners to lower the bending rigidity of the channel section.

This embodiment of the invention is preferable to conventional drainage channel systems because the cross member can be oriented at a desired angle relative to the legs. For example, if the bottom surface of a ditch is sloped in a direction transverse to the drainage channel sections, the cross member can be placed flat against the bottom surface and the legs moved so as to extend in a vertical direction, even though the cross member is not horizontal. Another advantageous application of this embodiment is in parking decks and the like where the drainage channel sections are placed on an underlying sloped concrete form. Moreover, the legs can be moved to a non-vertical position so that one upper side edge of the drainage channel is at a higher elevation that than the opposite upper side edge. Accordingly, the drainage channel can also function as a curb with the support frame of the present invention.

Advantageous methods associated with the apparatus also form a part of the invention and may include the steps of positioning a plurality of support frames, each having a pair of generally parallel legs and a cross member extending therebetween, on the support surface with the cross members adjacent to the support surface; supporting the channel sections in an end-to-end adjoining relationship on a plurality of support pieces on each of the parallel legs; driving an anchor member through an opening in each off the support frames to engage the support frame with the support surface and anchor the drainage channel sections to the support surface; and pouring the hardenable composition onto the support surface to a level corresponding to the upper side edges of the drainage channel sections. Preferably, the pouring step comprises pouring all of the hardenable composition in only one application.

BRIEF DESCRIPTION OF THE DRAWINGS

In the drawings which form a portion of the original disclosure of the invention, but which are not necessarily drawn to scale:

FIG. 1 is a perspective view of one preferred drainage channel system according to the present invention illustrating its placement in a preformed ditch;

FIG. 2 is a perspective view of the drainage channel system of FIG. 1 following placement thereof in a preformed ditch and pouring of hardenable composition about the drainage channel sections;

FIG. 7 is a sectional view of the support frame assembly taken along lines 7—7 of FIG. 4 illustrating the offset position of the anchor members.

DETAILED DESCRIPTION OF A PREFERRED EMBODIMENT

Figure 3:
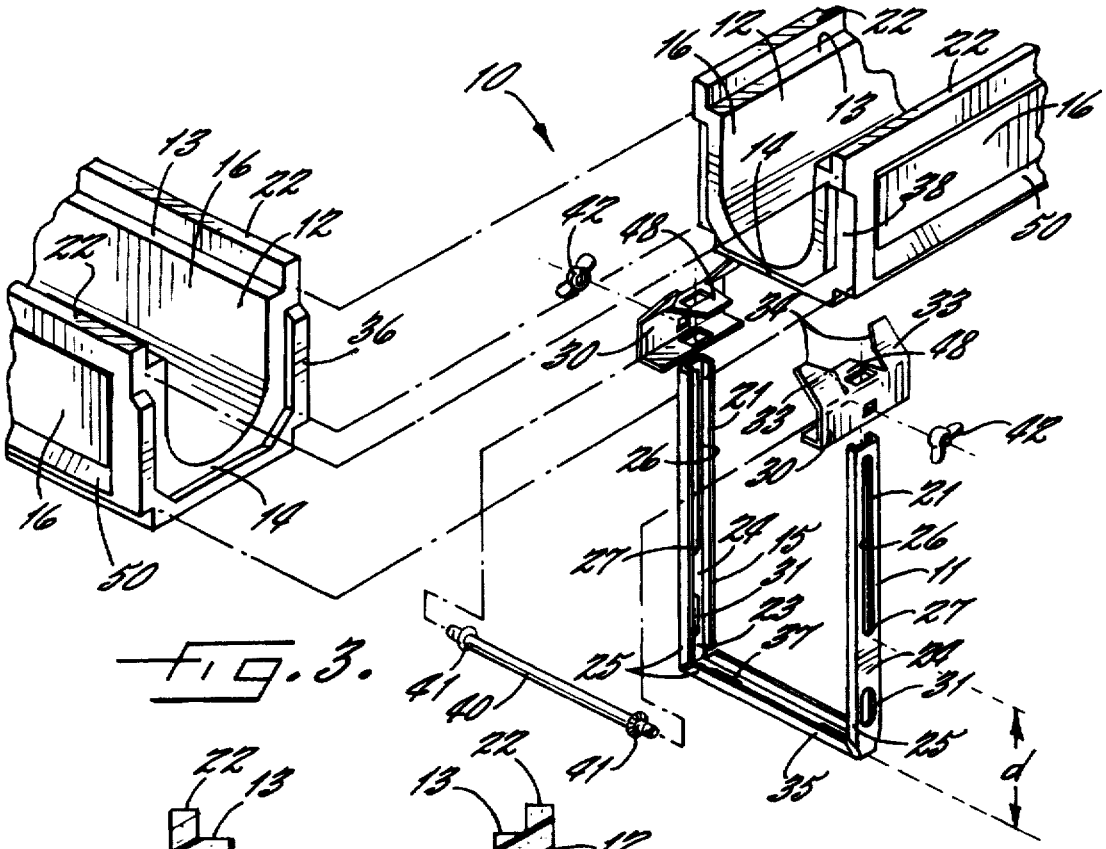
FIG. 3 is an exploded perspective view of one preferred support frame according to the present invention illustrating its relationship to the end portions of a pair of adjacent drainage channel sections and wherein the end portion of one channel section is shown in a rearranged horizontally transverse orientation in order to better illustrate the end face thereof.

Various methods and apparatus embodiments of the invention are set forth below. While the invention is described with reference to specific preferred methods and apparatus including those illustrated in the drawings, it will be understood that the invention is not intended to be so limited. To the contrary, the invention includes numerous alternatives, modifications and equivalents as will become apparent from consideration of the present specification including the drawings, the foregoing discussion, and the following detailed description.

Referring now to FIG. 1, a drainage channel system 10 according to one embodiment of the present invention is illustrated during placement in a preformed ditch. As shown, the drainage channel system 10 includes a plurality of longitudinally extending preformed or precast drainage channel sections 12. The drainage channel sections 12 can be precast from various cementitious materials depending upon the type of fluid which the trench is to collect and the type of loads which the trench is to designed support. For example, precast drainage channel sections are typically formed of polyester concrete, a concrete aggregate material containing coarse and inert mineral fillers bonded with polyester resin. As will be apparent, the channel sections can be cast from other cementitious materials and/or thermoformable or thermosetting polymers or formed from cast or formed metals such as stainless steel sheet.

Each drainage channel section 12 has a predetermined exterior shape defined by a bottom wall 14 and a pair of sidewalls 16 extending upwardly from opposite sides of the bottom wall. Upper portions of the opposed sidewalls 16 each include a longitudinally extending support surface 13. Each support surface 13 preferably extends substantially horizontally and is adapted to receive and support a trench cover 20 which covers the open top of the drainage channel sections 12 as shown in FIG. 2.

Each opposed sidewall 16 also preferably includes a longitudinally extending upper side edge 22 adjacent to the support surface 13. As shown, the vertical distance from the upper side edge 22 to the support surface 13 is preferably substantially equal to the thickness of the trench cover 20 such that the trench cover is aligned with upper side edges of the sidewalls 16 to provide a smooth surface, e.g., for vehicle travel. The support surface 13 and the adjacent upwardly extending edge portion of the opposed sidewalls of the drainage channel section 12 are preferably sized to receive the trench cover 20 and to stabilize the trench cover by preventing excessive lateral movement of the trench cover and by preventing the trench cover from rocking when weight is applied thereto.

The drainage channel system 10 of the present invention also includes a pair of channel support pieces 30 for aligning and interlocking adjacent drainage channel sections 12 as shown in FIG. 1. While the support pieces 30 can be formed of various materials, the support pieces of one embodiment are formed of steel, such as 12, 14 or 16 gauge low carbon steel. The support pieces 30 are of sufficient longitudinal length and shape for longitudinally bridging across predetermined exterior portions of the adjacent sidewalls 16 of the adjoining drainage channel sections 12.

Each of the support pieces 30 includes two clamping tabs or members 33 which include longitudinally opposed clamping surfaces 34 shaped to engage the exterior portion of a sidewall 16 and to urge the adjacent drainage channel sections 12 into an aligned, longitudinally engaged relationship. The longitudinally opposed surfaces 34 are diagonally oriented with respect to the longitudinal axis of the channel sections 12 and are thus opposed with respect to both the longitudinal and lateral axes of the channel section. The longitudinally opposed surfaces 34 apply a longitudinally compressive force to the adjacent drainage channel sections 12 as the channel support pieces 30 are moved in the laterally inward direction towards the center longitudinal axis of the channel sections to thereby substantially align and interlock the channel sections. Consequently, the resulting trench defined by the drainage channel sections 12 has aligned side 16 and bottom 14 walls and a relatively tight seal can be obtained between adjacent drainage channel sections. The support pieces 30 are preferably of the type discussed in more detail in allowed U.S. patent application Ser. No. 08/358,775 to Gunter, soon to issue as U.S. Pat. No. 5,522,675, which is incorporated herein by reference.

Although any of various channel constructions can be used in the invention, as illustrated in FIG. 3, the alignment and interlocking of adjacent drainage channel sections 12 can be facilitated by channel sections having corresponding male and female portions 36 and 38, respectively, defined by end portions of the adjacent drainage channel sections 12. More particularly, one end portion of a first drainage channel section can include a male lip or tongue portion 36 adapted to fit into a corresponding female recess or groove portion 38 defined on the opposite end portion of a second adjacent drainage channel section. In addition, a sealant or other type of adhesive can be disposed between the end portions of the adjacent drainage channel sections to further seal the adjacent drainage channel sections.

Advantageously, the drainage channel system 10 includes at least one connecting member 40 adjustably connecting the opposed support pieces 30 in a laterally spaced relationship, as can be seen in FIG. 3. The connecting member 40 preferably cooperates with a laterally movable fastener 42 to adjust the lateral spacing between the opposed channel support pieces 30. In particular, the fastener 42 and the connecting member 40 cooperate to apply a laterally inwardly directed force to the opposed channel support pieces 30.

In the illustrated embodiment, the connecting member 40 comprises a rod having threaded ends which are received by apertures defined in the support pieces 30. In particular, the rod 40 may also include backing members 41 adjacent to the threaded ends to provide a fixed stop for the laterally movable fastener 42. The backing members 41 are preferably formed by cold heading the rod 40, but may also be formed by other methods, such as welding a washer to the rod or fixing a backing nut on the threaded portion.

In the illustrated embodiment, the fastener 42 comprises a wing nut which can be threaded onto a threaded end of the rod 40 such that a laterally inwardly directed force is applied to the support piece 30 to draw or bias the support pieces 30 laterally inward. Due to the complimentary shapes of the exterior surface of the adjacent drainage channel sections 12 and the longitudinally opposed surfaces 34 of the support pieces 30, the application of a laterally inwardly directed force to the opposed support pieces applies longitudinal compressive force to the drainage channel sections, thereby longitudinally interlocking the drainage channel sections.

The inward movement of a support piece 30 is limited by the respective backing member 41. As such, each side can be independently tightened or loosened and, if one side is tightened, the connecting member 40 will not fall if the other side is loosened, which can be advantageous when adjusting the position of the drainage channel sections. The backing member 41 may include serrations to prevent the rod 40 from rotating when the fastener 42 is tightened.

Figure 4:
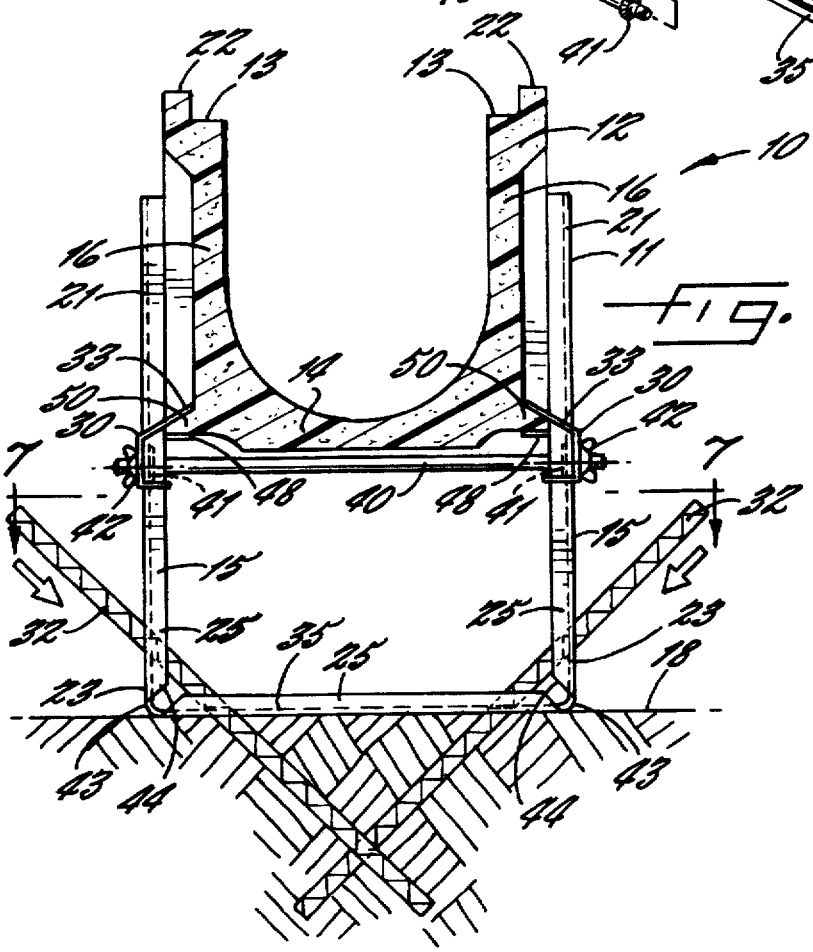
FIG. 4 is a sectional view of a support frame assembly according to the present invention illustrating the placement of a pair of anchor members in the earthen support surface of a ditch.
Figure 5:
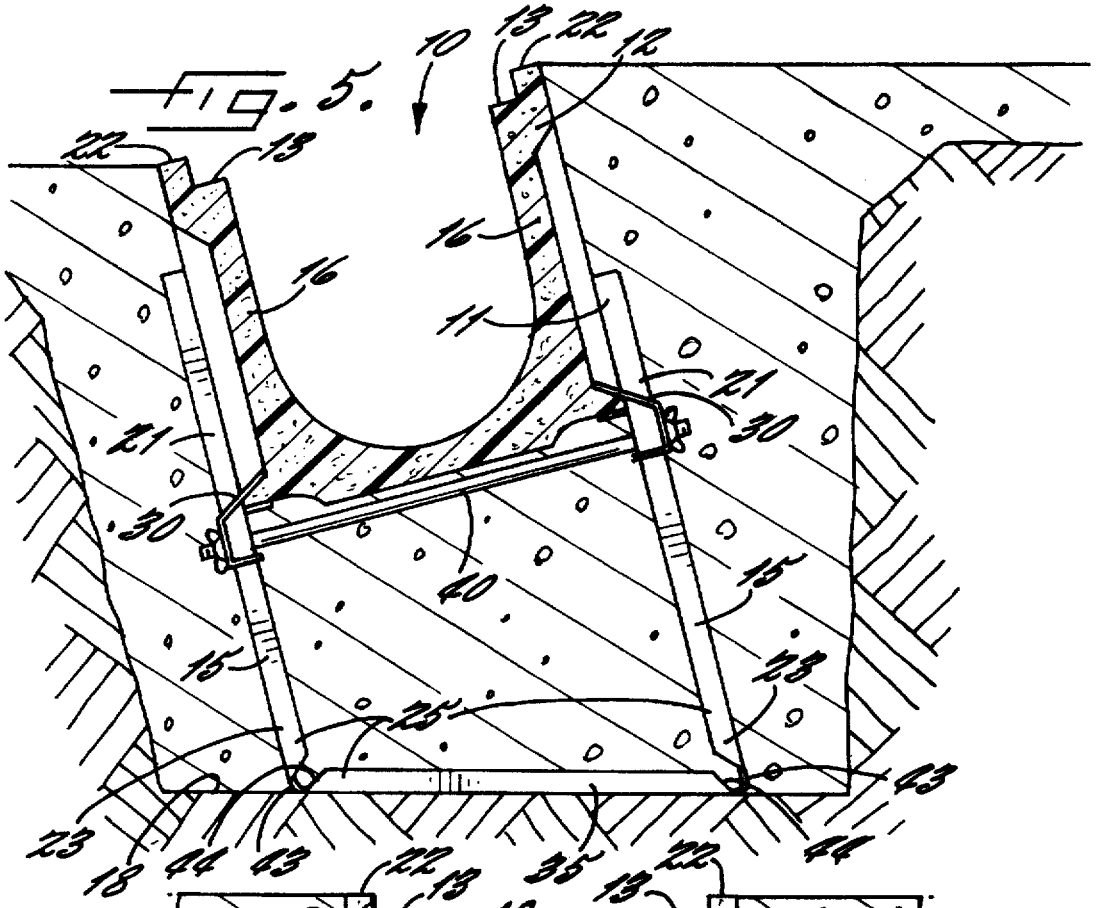
FIG. 5 is a sectional view of a support frame assembly according to the present invention illustrating the position of a pair of substantially vertical legs for forming a curb with the drainage channel sections.
Figure 6:
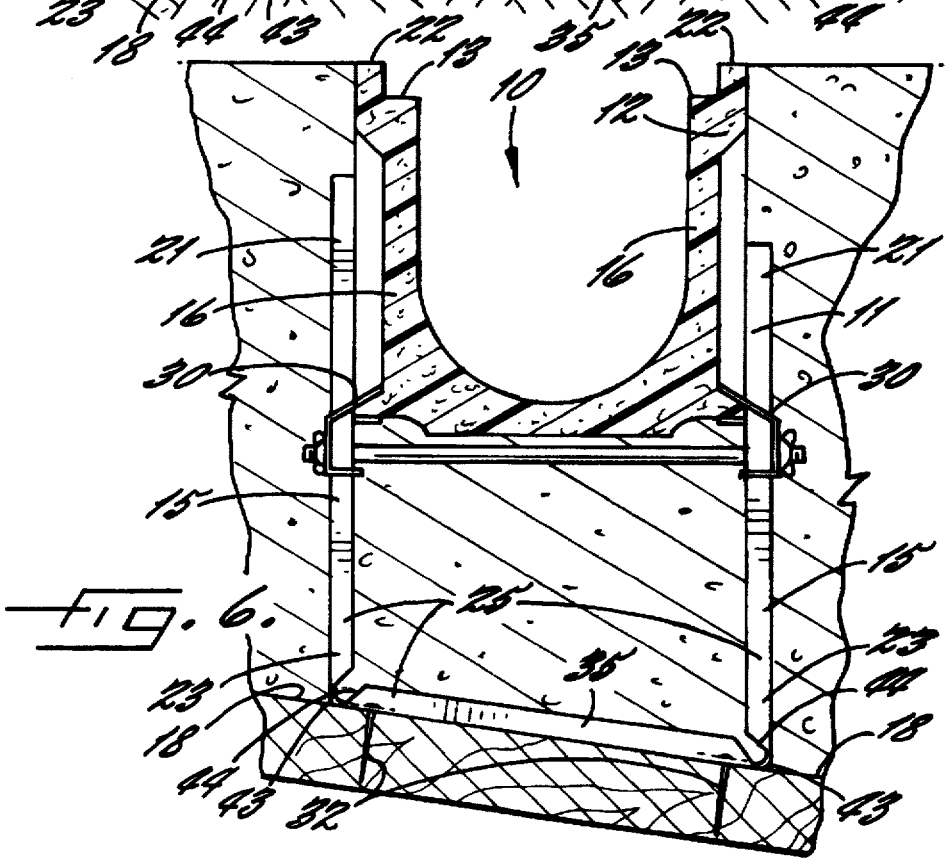
FIG. 6 is a sectional view of a support frame assembly according to the present invention illustrating the position of a cross member on an underlying sloped concrete form.

Each support piece 30 also preferably includes a surface positioned to engage predetermined exterior portions of the respective sidewalls 16 to support and align the adjacent drainage channel sections 12 at a predetermined relative vertical height. For example, as best illustrated in FIGS. 4, 5 and 6, each support piece 30 includes a substantially horizontally extending portion or horizontal tab 48. The horizontal tab 48 is positioned to engage a generally downwardly facing horizontal surface of longitudinally extending outwardly projecting ribs 50 defined along lower portions of the opposed sidewalls 16 of the channel sections 12. Accordingly, the generally horizontally extending tabs 48 engage and support lower portions of the longitudinally extending ribs 50 to support the adjacent drainage channel sections 12 in a predetermined vertical relationship.

The drainage channel sections are supported on a support frame 11 resting on the support surface 18. As illustrated in FIGS. 1, 2 and 5, the support surface 18 may be the earthen bottom surface of a preformed ditch. Alternatively, the support surface 18 may be an underlying concrete form made of steel or wood or the like, as is illustrated in FIG. 6.

The support frame 11 includes a pair of generally parallel legs 15 extending in a substantially vertical direction. Each of the legs includes an upper end portion 21 and a lower end portion 23. The legs 15 may be formed of any sufficiently strong material with one preferred material being 12 gauge low carbon steel.

The legs 15 are preferably formed of a generally C-shaped channel section including a substantially flat central wall 24 and a pair of opposed sidewalls 25 extending therefrom. This configuration gives the legs 15 a much higher bending rigidity than if the legs included only the central wall 24.

The flat central wall 24 includes a slot 26 extending along most of the length of the leg 15. The threaded portion of the connecting member 40 is positioned through the slot 26 and the support piece 30 before the fastener 42 is applied. Accordingly, the support pieces 30 are independently moveable up and down the legs 15 and the height of the drainage channel sections 12 can be adjusted before the concrete is poured.

The slot 26 preferably has a lower end 27 which is located at a predetermined distance d above the bottom end of the leg 16. In order to ensure that the drainage channel sections 12 have a proper foundation once the concrete has been poured, a predetermined thickness of the hardenable composition must be present between the bottom wall 14 of the drainage channel section 12 and the support surface 18. The minimum thickness for concrete is preferably about 4 inches. Thus, the distance d between the lower end 27 of the slot 26 and the support surface 18 is predetermined to ensure that the drainage channel sections 12 have sufficient hardenable composition beneath them, no matter where the support pieces 30 are positioned within the slot 26.

The legs 15 also include an opening 31 in the lower end portion 23 of the central wall 24. As described in more detail below, this opening 31 allows an anchor member 32 to extend through the support frame 11 and into the support surface 18.

The support frame 11 includes a cross member 35 extending between the lower end portions 23 of the legs 15 at a position below the channel support pieces 30. In particular, the legs 15 and cross member 35 are preferably formed of a continuous channel section of the type discussed above in connection with the legs. As such, the cross member 35 also includes a substantially flat central wall 24 and a pair of opposed sidewalls 25. In addition, the central wall 24 includes one or more openings 37*a*, 37*b* therein for receiving the anchor members 32.

When installing the drainage channel system 10 according to the present invention in an earthen ditch, a plurality of support frames 11 are placed in the ditch with the cross members 35 against the support surface 18. The drainage channel sections 12 are then placed on the support pieces 30 and the laterally movable fasteners 42 are tightened against the respective backing members 41. The support frames 11 can then be anchored in the ditch.

A pair of anchor members 32 are driven through the support frame 11 and into the underlying earthen support surface 18, as illustrated in FIGS. 4 and 7. Specifically, the openings 31 in the legs 15 and the openings 37*a* in the cross member 35 are of a sufficient size and shape to allow an anchor member 32 to extend therethrough. The anchor members 32 are preferably formed of lengths of conventional reinforcing steel bars, commonly known as "rebar". These bars are circular in cross section and the openings 31, 37*a* are oval in shape to allow the bars to extend at an angle therethrough.

In addition, the respective openings 31, 37*a* on each side of the support frame 11 are aligned to allow each anchor member 32 to extend through the support frame at an acute angle relative to the respective leg 15 and the cross member 35 and into the support surface 18 at an acute angle relative thereto. Accordingly, the anchor member 32 is driven at a slant into the underlying surface in a manner analogous to "toenailing" in conventional carpentry. The angled anchor members 32 provide much improved anchoring capabilities relative to the vertically extending stakes of the prior art because the anchor members 32 according to the present invention are not subjected to a buoyant force acting only in the direction in which the members 32 were driven into the ground. In other words, in order to forcibly remove the anchor member 32 according to the present invention in a vertically upward direction, significant amounts of soil would have to be moved aside by the anchor members 32. In contrast, if the vertical stakes of the prior art were forcibly removed, no soil would be disturbed as the stakes would come out the same way they were driven in.

In addition, having two opposed anchor members 32 acting in opposed directions even further enhances the anchoring ability of the present invention. As can be seen in FIG. 7, one or more of the openings 31, 37*a* is advantageously offset by a distance o relative to a center axis extending through the cross member 35 and legs 15 transversely to the drainage channel sections 12. More particularly, the pair of openings 37*a* in the cross member 35 are offset in opposite directions relative to the center axis by a distance o. The offset openings 37*a* guide the anchor members 32 in slightly offset directions so that they will not strike each other under the cross member 35, as can be seen in FIG. 4. A distance of about 0.031 inches is a preferred offset o although it will be readily understood that the offset o could be varied dependent on the size and geometry of the frame 11 and anchor members 32.

If the soil is so loose, however, as to require a subslab to hold down the drainage channel sections 12, as discussed above, it is not necessary to use the anchor members 32. The cross member 35 will be retained in the subslab and the laborious step of driving anchor members or stakes into the ground will be eliminated.

The drainage channel system 10 according to the present invention can also be installed on other support surfaces 18 such as the concrete form illustrated in FIG. 6. These forms 18 may be made of steel or wood or the like and will typically be used to define an upper wall of an underlying open space, such as the ceiling of a lower floor of a parking deck, etc. The forms 18 may be permanent or temporary and removed after the concrete has hardened.

A pair of smaller openings 37*b* are provided in the central wall 24 of the cross member 35 so that anchor members 32 can extend therethrough and secure the support frame 11 to the form 18. In this situation, the anchor members 32 may be nails, wood screws, metal screws or the like. In the case of a metal form or underlying reinforcement steel, the cross member 35 could even be tack welded in place.

As can be seen in FIG. 6, the underlying form 18 may be sloped from side to side, which could also be true for the support surface of an earthen ditch. The support frame 11 of the present invention advantageously includes hinge members 43 at each lower corner of the support frame which connect the cross member 35 with each of the legs 15. The hinge members 43 allow the legs 15 to pivot relative to the cross member 35 so that the legs can be oriented to define a predetermined angle with the cross member 35. In other words, the hinge members 43 will have a bending rigidity less than the bending rigidity of the legs Although any form of mechanical hinge may be used, a preferred construction is illustrated in FIGS. 5 and 6 wherein notches 44 are cut into the sidewalls 25 so that only the central wall 24 connects the cross member 35 and adjacent leg 15. The notches 44 lower the bending rigidity of the continuous channel section so that the legs can be bent over by an installer when the fastener 42 is loosened on the connecting member 40. The fastener 42 can thereafter be tightened to lock the support frame 11 in the desired orientation. Accordingly, the legs 15 can be oriented to extend vertically when the cross member 35 is placed on a sloped support surface Another application where the hinge members 43 of the present invention are useful is illustrated in FIG. 5. In particular, it may be desirable to provide a curb, as discussed in more detail above, in combination with a drainage channel. As used herein, the term "curb" is intended to indicate a change in elevation from one side of the curb to the other.

If the legs 15 of the support frame 11 are bent over, but the cross member 35 is placed on a generally horizontal support surface 18, the drainage channel sections 12 will be tilted at an angle. In other words, the upper side edge 22 of one sidewall 16 will be higher than the upper side edge of the opposite sidewall and, accordingly, the hardenable composition can be poured to an elevation higher on one side than on the other. The support frame 11 according to the present invention thus allows the drainage channel sections 12 to advantageously function as a curb for containment purposes. In addition, a flat trench cover 20 can be placed on the drainage channel sections 12 which provides a smooth transition from one side of the channel to the other. The sloped curb is preferable to stepped curbs in areas where vehicular traffic over the drainage channel system is desired.

Accordingly, the support frame 11 of the present invention is extremely versatile and can be readily adapted to support and anchor drainage channel sections 12 to a variety of types and shapes of support surfaces. For example, the support frame 11 can effectively support and anchor drainage channel sections 12 to earthen surfaces, wooden surfaces and concrete surfaces, either with or without pouring a subslab. In addition, the support frame 11 can readily support and anchor drainage channel sections 12 to support surfaces 18 which are uneven and which slope in a side-to-side fashion, thereby further increasing the versatility of the support frame of the present invention.

The invention has been described in considerable detail with reference to preferred embodiments. However, many changes, variations, and modifications can be made without departing from the spirit and scope of the invention as described in the foregoing specification and defined in the appended claims.

That which is claimed is:

1. A support frame assembly for supporting a plurality of drainage channel sections adjoined in an end-to-end relationship and for anchoring the drainage channel sections to a support surface, said support frame assembly comprising:

a pair of legs extending in a generally parallel direction and each having an upper end portion and a lower end portion;

a channel support piece mounted on each of said parallel legs adjacent said upper end portions for supporting the adjoining drainage channel sections;

a cross member extending between said lower end portions of said parallel legs at a position below said channel support pieces, said cross member defining at least one opening adjacent to the support surface; and at least one anchor member extending through said opening in said cross member and engaging the support surface to thereby anchor the frame assembly to the surface.

2. A support frame assembly as defined in claim 1 wherein at least one of said legs defines an opening aligned with said opening in said cross member and wherein said anchor member extends through both of said openings to define an acute angle with the support surface.

3. A support frame assembly as defined in claim 2 wherein said parallel legs and said cross member define a center axis transverse to the drainage channel sections and wherein at least one of said aligned openings is offset from said center axis.

4. A support frame assembly as defined in claim 3 wherein said opening in said cross member is offset from said center axis.

5. A support frame assembly as defined in claim 2 wherein said anchor member comprises a rod having a circular cross section and wherein said openings are oval in shape.

6. A support frame assembly as defined in claim 1 wherein each of said legs defines a slot having upper and lower ends and further comprising a fastener extending through each of said slots for fastening said channel support pieces to said legs.

7. A support frame assembly as defined in claim 6 wherein said lower end of said slot is at predetermined distance above said cross member.

8. A support frame assembly as defined in claim 1 wherein the support surface is the bottom surface of an earthen ditch and wherein said anchor member comprises a substantially rigid rod.

9. A support frame assembly as defined in claim 1 wherein the support surface is a wooden form and wherein said anchor member comprises a nail.

10. A support frame assembly as defined in claim 1 wherein the support surface is a metal form and wherein said anchor member comprises a screw.

11. A support frame assembly for supporting a plurality of drainage channel sections adjoined in an end-to-end relationship and for anchoring the drainage channel sections to an earthen support surface, said support frame assembly comprising:

a pair of legs extending in a generally parallel direction, each of said legs having an upper end portion and a lower end portion and defining an opening adjacent to said lower end portion;

a channel support piece mounted on each of said parallel legs adjacent said upper end portions for supporting the adjoining drainage channel sections;

a cross member extending between said lower end portions of said parallel legs at a position below said channel support pieces, said cross member defining a pair of openings both adjacent to the earthen support surface and each aligned with a respective opening in said legs; and a pair of anchor members each extending through the opening in one of said legs and through the respective aligned opening in said cross member and into the earthen support surface at an acute angle relative thereto to thereby anchor the frame assembly to the surface.

12. A support frame assembly as defined in claim 11 wherein said parallel legs and said cross member define a center axis transverse to the drainage channel sections and wherein at least one of said aligned openings is offset from said center axis.

13. A support frame assembly as defined in claim 12 wherein both of said openings in said cross member are offset from said center axis in opposite directions.

14. A support frame assembly as defined in claim 11 wherein each of said legs defines a slot having upper and lower ends and further comprising a fastener extending through each of said slots for fastening said channel support pieces to said legs.

15. A support frame assembly as defined in claim 14 wherein said lower end of said slot is at a predetermined distance above said cross member.

16. A support frame assembly as defined in claim 11 wherein said anchor members each comprise a rod having a circular cross section and wherein said openings are oval in shape.

17. A support frame for supporting a plurality of drainage channel sections adjoined in an end-to-end relationship on a support surface with an anchor member, said support frame comprising:

a pair of legs extending in a generally parallel direction and each having an upper end portion and a lower end portion;

a channel support piece mounted on each of said parallel legs adjacent said upper end portions for supporting the adjoining drainage channel sections; and a cross member extending between said lower end portions of said parallel legs at a position below said channel support pieces, said cross member defining at least one opening adjacent to the support surface and adapted to allow an anchor member to extend therethrough and engage the support surface to thereby anchor the frame to the surface.

18. A support frame as defined in claim 17 wherein at least one of said legs defines an opening aligned with said opening in said cross member and adapted to allow an anchor member to extend through both of said openings.

19. A support frame as defined in claim 18 wherein said parallel legs and said cross member define a center axis transverse to the drainage channel sections and wherein at least one of said aligned openings is offset from said center axis.

20. A support frame as defined in claim 19 wherein said opening in said cross member is offset from said center axis.

21. A support frame as defined in claim 17 wherein each of said legs defines a slot having upper and lower ends and further comprising a fastener extending through each of said slots for fastening said channel support pieces to said legs.

22. A support frame as defined in claim 21 wherein said lower end of said slot is at a predetermined distance above said cross member.

23. A support frame as defined in claim 17 wherein said opening is oval in shape.

24. A support frame as defined in claim 17 wherein said opening is round in shape.

25. A support frame for supporting and positioning a plurality of drainage channel sections adjoined in an end-to-end relationship on a support surface, said support frame comprising:

a pair of legs extending in a generally parallel direction each having an upper end portion and a lower end portion;

a channel support piece mounted on each of said parallel legs adjacent to said upper end portions for supporting the adjoining drainage channel sections;

a cross member extending between said lower end portions of said parallel legs at a position below said channel support pieces; and a hinge member connecting said cross member with each of said lower end portions of said legs, said hinge member allowing preferential movement of said legs in a plane defined by said legs and said cross member so that said legs can be oriented to define a predetermined angle with said cross member.

26. A support frame as defined in claim 25 wherein said hinge members each have a predetermined bending rigidity which is less than a predetermined bending rigidity of said legs and said cross member.

27. A support frame as defined in claim 26 wherein said legs and said cross member are formed of a continuous channel section having a central wall and a pair of opposed sidewalls, and wherein said sidewalls define notches adjacent to said hinge members.

28. A support frame as defined in claim 25 wherein the support surface slopes in a direction transverse to the drainage channel sections and wherein said parallel legs are oriented relative to said cross member so that the legs extend vertically when said cross member is positioned on the transversely sloping support surface.

29. A support frame as defined in claim 25 wherein the drainage channel sections have a pair of upper side edges and wherein said parallel legs of said support frame are oriented relative to cross member so that one of the upper edges of the drainage channel sections is at a higher elevation than the other.

30. A support frame for supporting and positioning a plurality of drainage channel sections adjoined in an end-to-end relationship on a support surface, said support frame comprising:

a pair of legs extending in a generally parallel direction each having an upper end portion and a lower end portion;

a channel support piece mounted on each of said parallel legs adjacent to said upper end portions for supporting the adjoining drainage channel sections;

a cross member extending between said lower end portions of said parallel legs at a position below said channel support pieces;

a hinge member connecting said cross member with each of said lower end portions of said legs, said hinge member allowing preferential movement of said legs in a plane defined by said legs and said cross member;

a connecting member extending between said channel support pieces; and a fastener acting in cooperation with said connecting member for fastening said support pieces to said legs once said legs have been oriented to define a predetermined angle with said cross member.

31. A support frame as defined in claim 30 wherein said hinge members each have a predetermined bending rigidity which is less than a predetermined bending rigidity of said legs and said cross member.

32. A support frame as defined in claim 31 wherein said legs and said cross member are formed of a continuous channel section having a central wall and a pair of opposed sidewalls, and wherein said sidewalls define notches adjacent to said hinge members.

33. A support frame as defined in claim 30 wherein the support surface slopes in a direction transverse to the drainage channel sections and wherein said parallel legs are oriented relative to the said cross member so that the legs extend vertically when said cross member is positioned on the support surface.

34. A support frame as defined in claim 30 wherein the drainage channel sections have a pair of upper side edges and wherein said parallel legs are oriented relative to said cross member so that one of the upper edges of the drainage channel sections is at a higher elevation than the other.

35. A method of encasing a plurality of drainage channel sections in a hardenable composition on a support surface, said method comprising the steps of:

positioning a plurality of support frames, each having a pair of generally parallel legs and a cross member extending therebetween, on the support surface with the cross members adjacent to the support surface;

supporting the channel sections in an end-to-end adjoining relationship on a plurality of support pieces mounted one on each of the parallel legs, each of the channel sections having a pair of upper side edges;

driving an anchor member through an opening in each of the support frames to engage the support frame with the support surface and anchor the drainage channel sections to the support surface; and pouring the hardenable composition onto the support surface to a level corresponding to the upper side edges of the drainage channel sections.

36. A method of encasing drainage channel sections as defined in claim 35 wherein said driving step further comprises driving the anchor member through an opening in one of the legs and the opening in the cross member so that the anchoring member enters the support surface at an acute angle relative thereto.

37. A method of encasing drainage channel sections as defined in claim 35 comprising the further step of driving a second anchor member through a second opening in the opposite leg and a second opening in the cross member so that the second anchor member enters the support surface at an acute angle relative thereto.

38. A method of encasing drainage channel sections as defined in claim 37 wherein said first and second driving steps further comprise driving the respective anchor members into the support surface towards each other until the anchor members cross each other under the cross member.

39. A method of encasing drainage channel sections as defined in claim 35 wherein said driving step further comprises urging a substantially rigid rod into an earthen support surface.

40. A method of encasing drainage channel sections as defined in claim 35 wherein said driving step further comprises hammering a nail into a wooden support surface.

41. A method of encasing drainage channel sections as defined in claim 35 wherein said driving step further comprises screwing a screw into the support surface.

42. A method of encasing drainage channel sections as defined in claim 35 wherein said pouring step comprises pouring the hardenable composition in only one application.

43. A method of encasing drainage channel sections as defined in claim 35 wherein the support surface slopes in a direction transverse to the drainage channel sections and wherein said positioning step further comprises orienting the parallel legs relative to the respective cross member so that the legs extend vertically when the cross member is positioned on the transversely sloping support surface.

44. A method of encasing drainage channel sections as defined in claim 35 wherein said positioning step further comprises orienting the parallel legs relative to the respective cross member so that one of the upper side edges of the drainage channel sections is at a higher elevation than the other.

45. A method of anchoring a plurality of drainage channel sections on a support surface before encasing the channel sections in a hardenable composition, said method comprising the steps of:

positioning a plurality of support frames, each having a pair of generally parallel legs and a cross member extending therebetween, on the support surface with the cross members adjacent to the support surface;

supporting the channel sections in an end-to-end adjoining relationship on a plurality of support pieces mounted one on each of the parallel legs; and driving an anchor member through an opening in each of the cross members of the support frames at an acute angle relative to the cross member so that the anchoring member enters the support surface at an acute angle relative thereto to anchor the drainage channel sections to the support surface.

46. A method of encasing drainage channel sections as defined in claim 45 wherein said driving step further comprises driving the anchor member through an opening in one of the legs and the opening in the cross member so that the anchor member enters the support surface at an acute angle relative thereto.

47. A method of encasing drainage channel sections as defined in claim 46 comprising the further step of driving a second anchor member through a second opening in the opposite leg and a second opening in the cross member so that the second anchoring member enters the support surface at an acute angle relative thereto.

48. A method of encasing drainage channel sections as defined in claim 47 wherein said first and second driving steps further comprise driving the respective anchor members into the support surface towards each other until the anchor members cross each other under the cross member.

49. A method of encasing drainage channel sections as defined in claim 45 wherein said driving step further comprises urging a substantially rigid rod into an earthen support surface.

50. A method of encasing drainage channel sections as defined in claim 45 wherein the support surface slopes in a direction transverse to the drainage channel sections and wherein said positioning step further comprises orienting the parallel legs relative to the respective cross member so that the legs extend vertically when the cross member is positioned on the support surface.

51. A method of encasing drainage channel sections as defined in claim 45 wherein the drainage channel sections have a pair of upper side edges and wherein said positioning step further comprises orienting the parallel legs relative to the respective cross member so that one of the upper side edges of the drainage channel sections is at a higher elevation than the other.

* * * * *

UNITED STATES PATENT AND TRADEMARK OFFICE

CERTIFICATE OF CORRECTION

PATENT NO. : 5,735,637

DATED : April 7, 1998

INVENTOR(S) : Charles E. Gunter

It is certified that error appears in the above-identified patent and that said Letters Patent is hereby corrected as shown below:

Column 13, line 55, before "cross", insert --said--.

Signed and Sealed this

Twentieth Day of October, 1998

Bruce Lehman

*Attest:*

BRUCE LEHMAN

*Attesting Officer*

*Commissioner of Patents and Trademarks*